US005690389A

United States Patent [19]

Ekman et al.

[11] Patent Number: 5,690,389

[45] Date of Patent: Nov. 25, 1997

[54] PNEUMATIC, BALL-SHAPED CHAIR

[76] Inventors: June Ekman, 47 W. 28th St., New York, N.Y. 10001; Laurence A. Wilson, R.R. 1, Box 55, Uniondale, Pa. 18470

[21] Appl. No.: 709,953

[22] Filed: Sep. 9, 1996

[51] Int. Cl.[6] ..... A47C 3/00

[52] U.S. Cl. ..... 297/452.41; 297/452.1; 248/599

[58] Field of Search ..... 297/452.1, 452.17, 297/452.41; 482/77; 472/134, 135; 248/562, 599

[56] References Cited

U.S. PATENT DOCUMENTS

| | | | |
|---|---|---|---|
| 3,476,497 | 11/1969 | Cashen et al. | 472/135 X |
| 4,438,919 | 3/1984 | Gamzo | 472/134 |
| 5,044,587 | 9/1991 | Degen | 248/158 |
| 5,364,161 | 11/1994 | Liu | 472/134 |

FOREIGN PATENT DOCUMENTS

| | | | |
|---|---|---|---|
| 2029946 | 11/1971 | Germany | 482/77 |
| 2643730 | 3/1978 | Germany | 482/77 |

*Primary Examiner*—Peter R. Brown
*Attorney, Agent, or Firm*—Salzman & Levy

[57] ABSTRACT

The present invention features a chair having a large, inflated, ball-shaped seat. The ball-shaped seat of the chair re-forms in response to an individual's weight and his or her seated position. The ball-shaped seat's height is adjustable, so as to conform to differently-sized individuals. The deformable surface of the ball allows the spine of a seated individual to align itself. This activates the individual's trunk and back muscles, and makes comfortable and therapeutic seating possible for a wide variety of individuals, even those with back problems. The shell of the inflated ball can have a flexible, tough skin that is formed of rubber, plastic, leather or other air-impermeable material. For comfort and/or esthetic purposes, the shell can be covered with fabric or vinyl. Side handles can also be provided for comfort and stability. Additionally, casters can be provided for easy movement about the floor. Further, a back support can also be provided in order to maintain an individual's seated balance upon the ball.

16 Claims, 3 Drawing Sheets

PNEUMATIC, BALL-SHAPED CHAIR

FIELD OF THE INVENTION

The present invention pertains to chairs and, more particularly, to a ball-shaped chair or stool comprising an inflatable structure that is especially useful in providing comfortable seating for individuals suffering from back problems, or those persons seated for an extended period of time.

BACKGROUND OF THE INVENTION

There are a myriad of chair designs extant, many of which claim to be more efficient, more comfortable, or more therapeutic than others. Recently, foam and rubber materials have been used in chair manufacture, so as to provide soft, flexible surfaces. Foam and rubber surfaces lend support, while also providing comfort. Foam materials can be designed to provide either stiff or soft support. Strategic placement of stiffening materials within soft foam or rubber shells have been found useful in delivering sustained back comfort over extended periods of time for individuals having normal spine alignments. However, a great number of people have moderate-to-severe back problems.

One particular problem confronting chair designers is the development of a chair or stool that will be comfortable to individuals with special needs, i.e., individuals who work long hours at a desk, who have back problems (e.g., herniated disks, scoliosis, etc.). It is commonplace to find comfortable chairs for those with normal spines; but it is rare to find comfortable chairs for those people having spinal curvatures or sciatica, for example. For the latter, the discomfort is particularly exacerbated, when seated for extended periods of time. While the use of foam or rubber materials is helpful in alleviating back pain, it is not a complete answer for serious back ailments and/or sustained seating.

The present invention is a chair or stool that provides comfort to those individuals having back problems or who have to sit for extended periods of time. Moreover, the chair of this invention provides therapeutic value for those who need or desire to strengthen their inherent trunk and/or back muscles.

The current invention reflects the discovery that people who sit upon an inflated, spherical shell or a pneumatic ball appear to be able to sit in comfort over an extended period of time. The inflatable, curved surface allows the anomalies of the spine to adjust and align with the "floating", spherical support, thus providing sustained comfort and/or therapy.

DISCUSSION OF RELATED ART

In U.S. Pat. No. 5,044,587 (issued to DEGEN on Sep. 3, 1991, and entitled "Ergonomic Seat"), an adjustable, rubber-cushioned seat is illustrated. The spherically-shaped, rubber cushion, combined with its elastic, angularly-adjustable support base, provides for the adjustment of posture with the shifting of seated weight.

The present invention differs from the ergonomic seat of the aforementioned patent in that the current invention is not angularly adjusted. The present invention does not adjust the seat to the individual person; it does just the opposite: it allows the spine of an individual to adjust to the seat. The seat of this invention comprises a variably-inflatable shell that shifts according to a change in an individual's seating position or the movement of weight. Further, the invention does not feature an elastic support base; it adjusts the height of the seat, its handles, and the back support orientation to conform to the size of a person.

SUMMARY OF THE INVENTION

In accordance with the present invention, there is provided a chair comprising a large, inflated, ball-shaped seat. The ball-shaped seat of the chair re-forms in response to an individual's weight and his or her seated position. The ball-shaped seat's height and inflation are adjustable, so as to conform to differently-sized individuals. The deformable surface of the ball allows the spine of a seated individual to align itself, thus encouraging and facilitating the user's trunk and back muscles to become stronger. This makes comfortable seating possible for a wide variety of individuals, even those with back problems. The shell of the inflated ball can comprise a flexible, tough skin that is formed of vinyl, rubber, plastic, leather or other air-impermeable material. For comfort and/or esthetic purposes, the shell can be covered with fabric or vinyl. Side handles can also be provided for comfort and stability. Additionally, casters can be provided for easy movement about the floor. Further, back and even neck supports can be provided in order to maintain an individual's seated balance upon the ball.

BRIEF DESCRIPTION OF THE DRAWINGS

A complete understanding of the present invention may be obtained by reference to the accompanying drawings, when taken in conjunction with the subsequent, detailed description thereof, in which.

For the purposes of clarity and brevity, like components and elements will bear the same numbers and designations throughout the FIGURES.

DESCRIPTION OF THE PREFERRED EMBODIMENT

Generally speaking, the invention features a stool or chair comprising a spherical seat-base. The spherical base is supported on a stationary platform or a movable platform comprising a number of casters. Side handles, as well as a back support, provide additional stability and comfort for a seated person. The spherical seat-base comprises an inflatable ball having a shell or skin that is substantially air-impermeable and flexible. The flexibility of the shell allows the spine of a seated individual to properly adjust itself into alignment with respect to the support provided by the chair. Trunk and back muscles can be strengthened when the user is so seated. Thus, the chair will provide seating comfort and therapy over an extended period of time.

Figure 1:
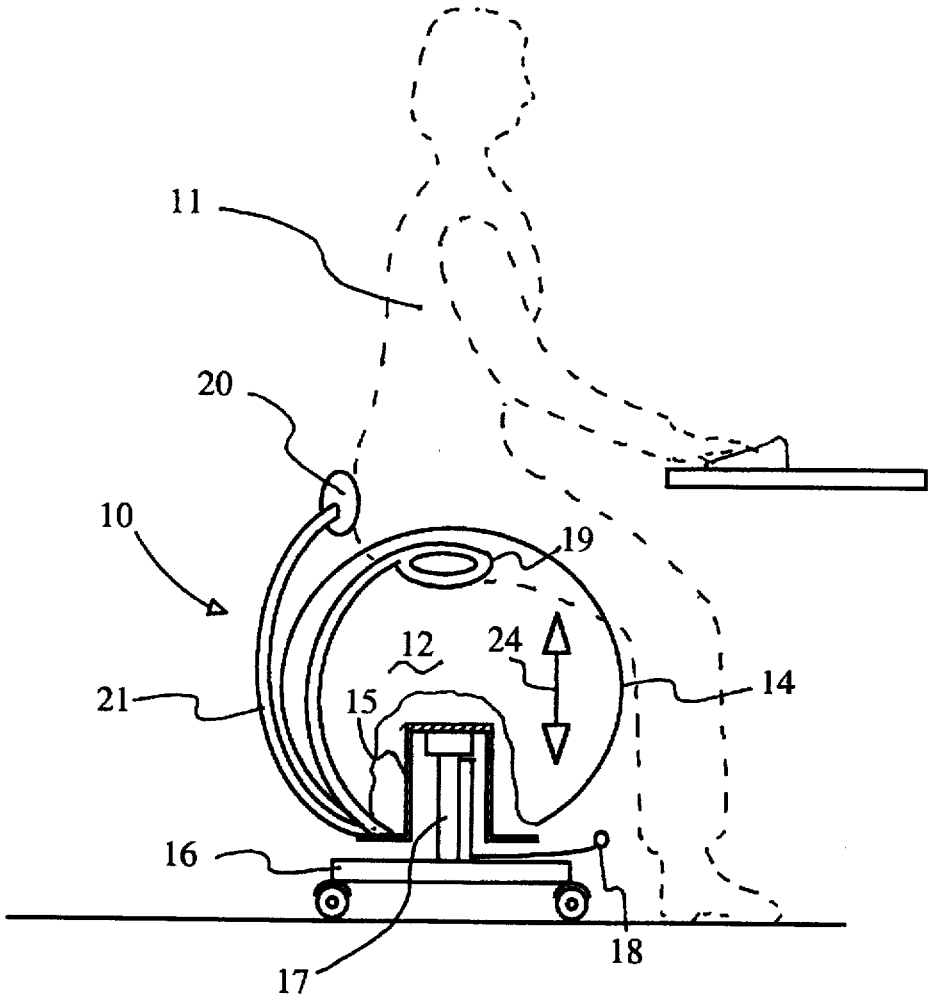
FIG 1 illustrates a side, in situ view of the ball-shaped chair of this invention.
Figure 1A:
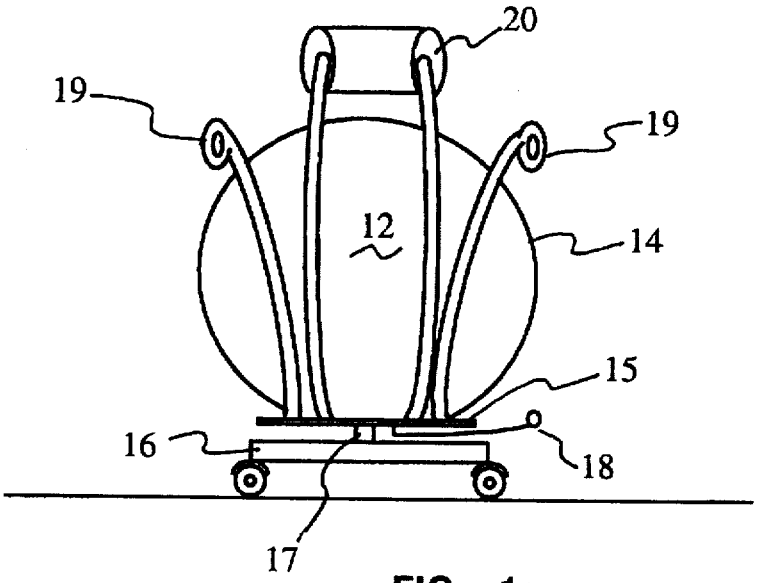
FIG. 1*a* shows a back view of the ball-shaped chair depicted in FIG. 1.
Figure 1B:
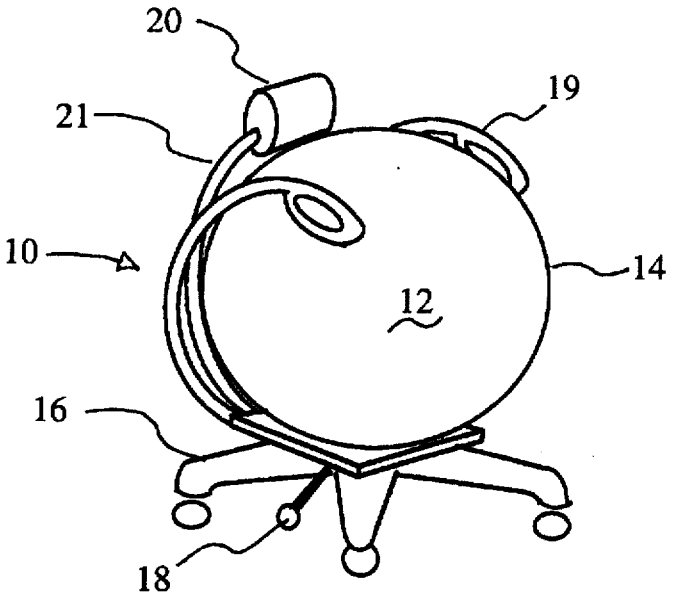
FIG. 1*b* shows a perspective view of the ball-shaped chair depicted in FIG. 1.

Now referring to FIGS. 1, 1*a* and 1*b*, the ball-shaped chair 10 of this invention is depicted. A person 11 (shown here in phantom) sits upon a substantially spherical seat 12 of the ball-shaped chair 10. The spherical seat 12 comprises an inflatable skin or shell 14. The skin 14 is air-impermeable, flexible and tough. The skin 14 allows the person's spine (not shown) to vertically adjust itself with respect to the support being provided by the ball-shaped chair 10. The shell 14 is supported upon a frame 15. The frame 15 is vertically adjustable (arrows 24), with respect to a movable base 16, by means of a hydraulic or a pneumatic adjustment-cylinder 17 that can be pumped by a foot lever 18. This adjustment-cylinder 17 may also comprise a mechanical rack and pinion, or a worm wheel drive.

The skin 14 of the ball-shaped chair 10 may be fabricated from a flexible, air-impermeable plastic (such as polypropylene or vinyl); a rubber material (such as neoprene); or a leather material. As aforementioned, the inflatable, flexible skin 14 re-forms in response to the weight and seated position of the person 11, thus allowing the spine of the seated individual to properly adjust to the ball-shaped chair 10.

The movable base 16 may comprise rollers, casters, ball wheels or other rolling supports known in this art. Likewise, for specific applications (e.g., classrooms), a non-rolling base can be used.

To provide added stability and support to the individual 11, right and left arms 19 are provided as handles to aid in moving the chair and to facilitate sitting. A support pad 20 helps align the individual with respect to the chair 10.

Figure 2:
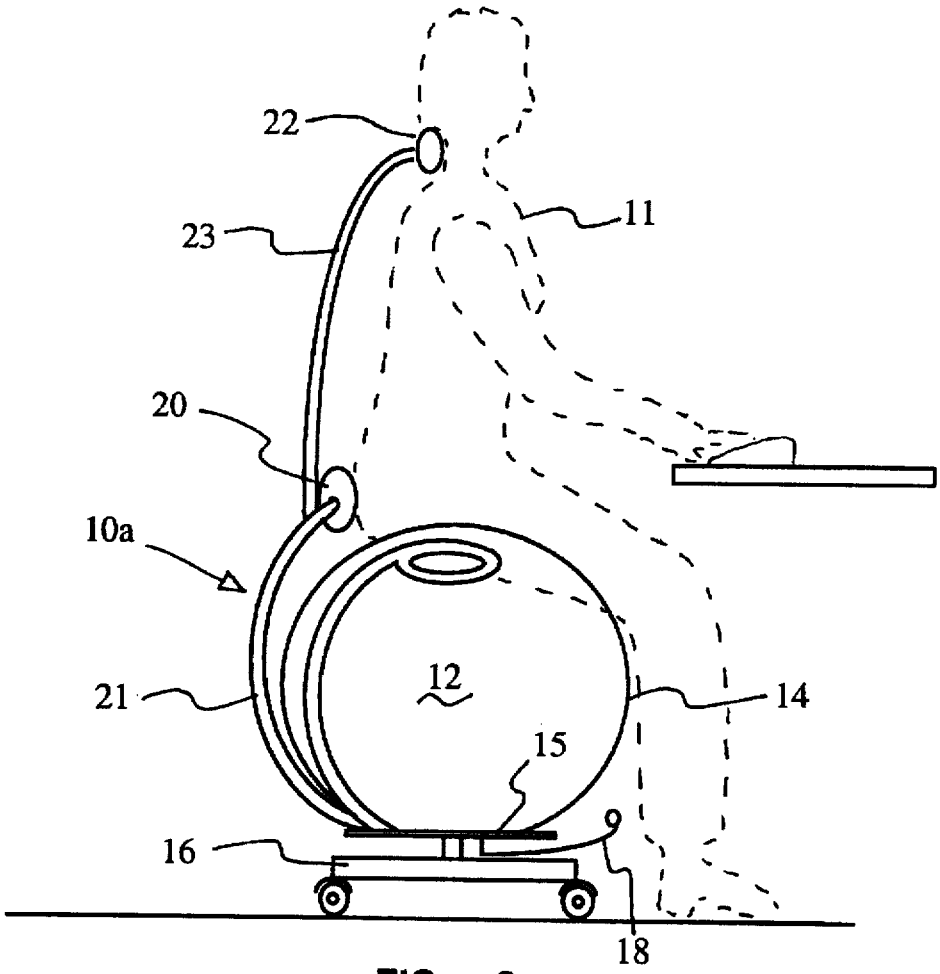
FIG. 2 depicts a side, in situ view of an alternate embodiment of the ball-shaped chair shown in FIG. 1.

Referring to FIG. 2, a ball-shaped chair 10*a* is shown. The ball-shaped chair 10*a* is an alternate embodiment of the chair 10 illustrated in FIG. 1. The ball-shaped chair 10*a* operates and functions the same in all respects as the ball-shaped chair 10, with one exception, viz., a neck support 22 is carried upon a link 23 (which may be adjustable for height), that, in turn, is attached to the link 21 supporting the back support-pad 20. Alternatively, neck support 22 and link 23 may be attached directly to frame 15 by suitable means.

Figure 3:
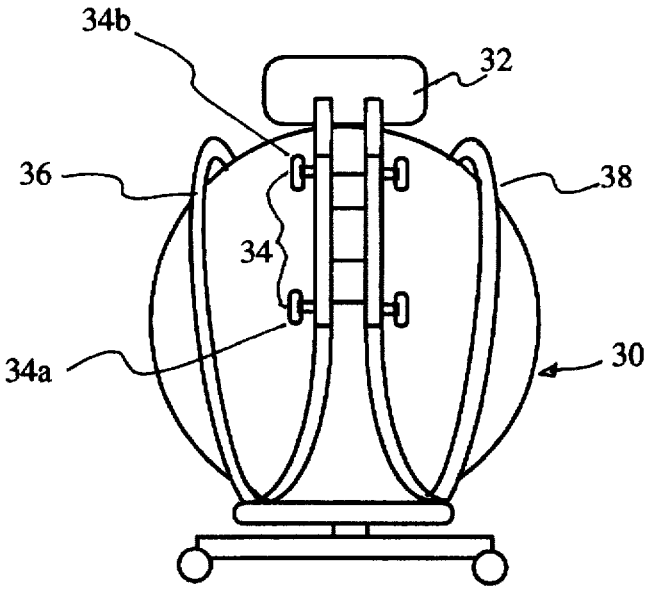
FIG. 3 depicts a back view of another alternate embodiment of the ball-shaped chair of this invention.

Referring now also to FIG. 3, there is shown another embodiment of the inventive ball-chair, shown generally at reference numeral 30. Support pad 32 may be adjusted, relative to the ball, in two ways: vertically and horizontally. An adjustment mechanism 34, connected to support pad 32, provides the means for these two adjustments. Screw knobs 34*a* provide adjustment of support pad 32 in a vertical direction. By loosening and tightening hobs 34*a*, support pad 32 can be made to extend upwardly and can then be locked in position. Adjustment knobs 34*b* can be loosened and tightened in order to lock supporting pad 32 in position horizontally, perpendicular to the plane of FIG. 3 (i.e., farther or closer to the central, vertical axis of the ball, not shown.

Another feature of this embodiment 30 is movable arms 36, 38. Left arm 36, for example, can be mounted to the frame of ball-chair 30 by suitable means, so as to facilitate adjustment of the arm 36 towards or away from the central, vertical axis of the ball. Arms 36 and 38 are independently adjustable in order to accommodate specific needs or desires of the user.

An inflation device, shown schematically as reference numeral 40, can also be provided to increase or decrease the air pressure within the ball of chair 30. This inflation device may be any one of a number of mechanisms for pumping air, well known in the art. For example, a bicycle tire air pump may be used; a foot-operated mechanical pump may be employed; or an electrically-operated compressor may be utilized to provide the appropriate air pumping function.

Figure 4A:
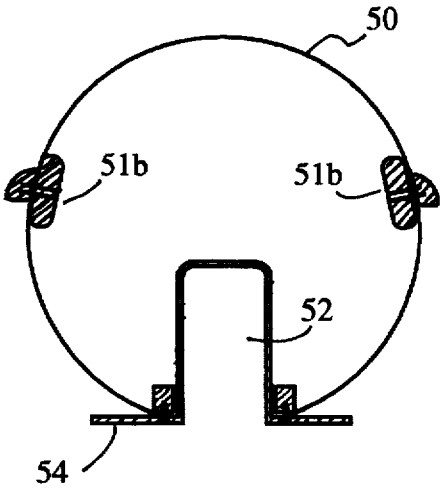
FIG. 4*a* and 4*b* depict schematic, cross-sectional views of backless ball stools.

Referring now also to FIG. 4*a*, there is shown a stool 50 having arms or handles 51*a* and 51*b*, but no support pad. The stool 50 is generally spherical, but includes a cavity 52 in which is disposed a stand 54, which although movable, is not disposed on wheels or casters.

Figure 4B:
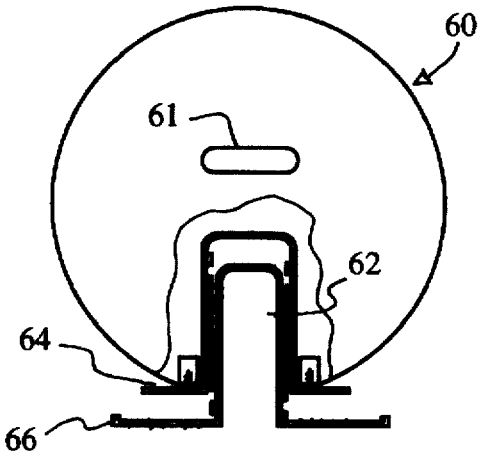

Similarly, FIG. 4*b* depicts a cross-sectional view of another embodiment of the invention. This adjustable-height stool, shown generally at reference numeral 60, includes one or more handles 61 and, in its cavity 62, a frame 64 that is adjustable by suitable means well known in the art, relative to stationary stand 66. Once again, the stool 60 includes no support pad nor casters.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

Having described the invention, what is desired to be protected by Letters Patent is presented by the subsequently appended claims.

What is claimed is:

1. A chair for allowing the spine of an individual to vertically adjust and activate the individual's trunk muscles, as the individual shifts position upon a seat support of said chair, comprising:

an inflatable shell forming a substantially spherical seat base upon which an individual can be seated, said inflatable shell being flexible for activating the individual's trunk muscles and allowing the seated individual's spine to adjust as said seated individual shifts position upon said spherical seat base;

support means for carrying said inflatable shell; and adjustment means disposed between said inflatable shell and said support means for adjusting a vertical position of said inflatable shell.

2. The chair that allows the spine of an individual to vertically adjust and activate the individual's trunk muscles, as the individual shifts position upon a seat support of said chair, in accordance with claim 1, further comprising handle means to facilitate moving the chair carried by said support means.

3. The chair that allows the spine of an individual to vertically adjust and activate the individual's trunk muscles, as the individual shifts position upon a seat support of said chair, in accordance with claim 2, wherein said arm supports are individually adjustable with respect to said support means.

4. The chair that allows the spine of an individual to vertically adjust and activate the individual's trunk muscles, as the individual shifts position upon a seat support of said chair, in accordance with claim 1, wherein said support means comprises rolling means for moving said chair.

5. The chair that allows the spine of an individual to vertically adjust and activate the individual's trunk muscles, as the individual shifts position upon a seat support of said chair, in accordance with claim 1, further comprising a back support-pad carried by said support means.

6. The chair that allows the spine of an individual to vertically adjust and activate the individual's trunk muscles, as the individual shifts position upon a seat support of said chair, in accordance with claim 5, further comprising means operatively connected to said back support-pad for adjusting the position thereof.

7. The chair that allows the spine of an individual to vertically adjust and activate the individual's trunk muscles, as the individual shifts position upon a seat support of said chair, in accordance with claim 5, further comprising means operatively connected to said inflatable shell for increasing air pressure therein.

8. The chair that allows the spine of an individual to vertically adjust and activate the individual's trunk muscles, as the individual shifts position upon a seat support of said chair, in accordance with claim 1, further comprising means operatively connected to said inflatable shell for increasing air pressure therein.

9. The chair in accordance with claim 8, further comprising a back support-pad carried by said support means.

10. The chair in accordance with claim 9, further comprising means operatively connected to said back support-pad for the positional adjustment thereof.

11. A chair that deforms to the shifting position of an individual seated thereon comprising:

an air-impermeable shell forming a substantially spherical seat base upon which an individual can be seated, said air-impermeable shell being flexible for deforming to a shifting position of a seated individual;

support means for carrying said air-impermeable shell; and adjustment means disposed between said air-impermeable shell and said support means for adjusting a vertical position of said air-impermeable shell.

12. The chair in accordance with claim 11, further comprising handle means to facilitate moving the chair carried by said support means.

13. The chair in accordance with claim 12, wherein said arm supports are individually adjustable with respect to said support means.

14. The chair in accordance with claim 13, further comprising a back support-pad carried by said support means.

15. The chair in accordance with claim 11, wherein said support means comprises rolling means for moving said chair.

16. A ball-shaped stool that deforms to the shifting position of an individual upon a substantially spherical seat support of said stool, comprising:

an air-impermeable, ball-shaped shell forming a substantially spherical seat base upon which an individual can be seated, said air-impermeable, ball-shaped shell being flexible for deforming to a shifting position of a seated individual;

support means for carrying said air-impermeable ball-shaped shell, said support means comprising rolling means for moving said stool;

mounting means disposed between said air-impermeable, ball-shaped shell and said support means for seating and stabilizing said air impermeable, ball-shaped shell with respect to said support means; and handle means carried by said support means, said handle means being individually adjustable with respect to said support means.

* * * * *